US007849617B2

(12) United States Patent
Intagliata et al.

(10) Patent No.: US 7,849,617 B2
(45) Date of Patent: Dec. 14, 2010

(54) SELF-RIGHTING POST AND METHOD FOR THE ASSEMBLY AND USE THEREOF

(75) Inventors: John D. Intagliata, Antelope, CA (US); Kent A. Kekeis, St. John, IN (US)

(73) Assignee: Energy Absorption Systems, Inc., Chicago, IL (US)

( * ) Notice: Subject to any disclaimer, the term of this patent is extended or adjusted under 35 U.S.C. 154(b) by 277 days.

(21) Appl. No.: 11/809,242

(22) Filed: May 31, 2007

(65) Prior Publication Data

US 2008/0295375 A1 Dec. 4, 2008

(51) Int. Cl.
*G09F 15/00* (2006.01)

(52) U.S. Cl. ..... 40/608; 248/160; 248/417

(58) Field of Classification Search ..... 40/608; 248/160, 417, 900, 143
See application file for complete search history.

(56) References Cited

U.S. PATENT DOCUMENTS 1,691,126 A * 11/1928 Rank et al. ..... 40/608
1,726,817 A * 9/1929 Franklin ..... 40/608
1,755,443 A 4/1930 Hartzler et al.
3,843,079 A 10/1974 Reisling
3,875,720 A 4/1975 Russell
3,913,518 A * 10/1975 Kaplan ..... 116/63 C
4,084,914 A 4/1978 Humphrey et al.
4,092,081 A 5/1978 Schmanski
4,106,879 A * 8/1978 Diedershagen et al. ..... 404/10
4,240,766 A 12/1980 Smith et al.
4,269,534 A 5/1981 Ryan
4,343,567 A * 8/1982 Sarver et al. ..... 404/10
4,486,117 A 12/1984 Blau
4,522,530 A 6/1985 Arthur (Continued)

OTHER PUBLICATIONS

"Options and Applications for Flexi-Guide® 300 Posts, Signs," Davidson Traffic Control Products, date unknown, 2 pages.

(Continued)

*Primary Examiner*—Lesley Morris
*Assistant Examiner*—Kristina Staley
(74) *Attorney, Agent, or Firm*—Brinks Hofer Gilson & Lione

(57) ABSTRACT

A self-righting post assembly includes an elastomeric hinge tube and an elastomeric inner member is disposed in the hinge tube. In one embodiment, an extension post is disposed over the hinge tube. A sign panel can be secured to the extension post. In one embodiment, the inner member is free of any engagement with the hinge tube. In one embodiment, the hinge tube is secured to a base, preferably with a vertically oriented fastener. A method of assembling the post assembly is also provided.

28 Claims, 11 Drawing Sheets

U.S. PATENT DOCUMENTS

| | | | | |
|---|---|---|---|---|
| 4,636,108 | A | 1/1987 | Duckett | |
| 4,636,109 | A * | 1/1987 | Clausen et al. | 404/10 |
| 4,645,168 | A | 2/1987 | Beard | |
| 4,806,046 | A | 2/1989 | Clark | |
| 5,197,819 | A | 3/1993 | Hughes | |
| 5,199,814 | A | 4/1993 | Clark et al. | |
| 5,207,175 | A * | 5/1993 | Andonian | 116/209 |
| 5,267,523 | A | 12/1993 | Hugron | |
| 5,354,144 | A | 10/1994 | Lizakowski | |
| 5,452,965 | A | 9/1995 | Hughes, Sr. | |
| 5,484,217 | A | 1/1996 | Carroll et al. | |
| 5,518,337 | A | 5/1996 | Modlin | |
| 5,560,732 | A | 10/1996 | Kulp et al. | |
| 5,670,954 | A | 9/1997 | Junker | |
| 5,703,577 | A * | 12/1997 | Carter | 340/908 |
| 5,788,405 | A | 8/1998 | Beard | |
| 5,908,262 | A * | 6/1999 | Ahn | 404/9 |
| 6,053,658 | A | 4/2000 | Gibson, Jr. | |
| 6,182,600 | B1 | 2/2001 | Brown et al. | |
| 6,719,484 | B1 | 4/2004 | Johnson | |

OTHER PUBLICATIONS

"2003 MUTCD Standard In-Street School Crosswalk Sign," Impact Recovery Systems, Jan. 2005, 1 page.

"Carsonite Product Specification Channelizer," ENGPPEC129B, and Figures 1-2, date unknown, 5 pages.

"Surface Mounted Highway Delineators," Roadtech Mfg. webpage, http://www.roadtech.com/flex_sm.html, 2007, pp. 1 and 2.

"FlexStake™ Tubular marker," Roadtech Mfg. webpage, http://www.roadtech.com/flex_tm.html, 2007, pp. 1 and 2.

Photos and schematic of FlexStake markers, dated prior to May 2007, 1 page.

* cited by examiner

SELF-RIGHTING POST AND METHOD FOR THE ASSEMBLY AND USE THEREOF

FIELD OF THE INVENTION

The present invention relates generally to a self-righting post, for example for use as a delineator or for supporting a sign, and to the method of assembling and using such a post.

BACKGROUND

Current delineator posts have a number of limitations. For example, a conventional delineator post may have single thickness wall, such that the delineator post may collapse at a flexing point when the post is pushed over (either by a person or by a vehicle), with the post then unable to return itself to a vertical orientation. In addition, conventional posts are often constructed of metal, polyethylene or other plastics, which are often incapable of returning to a vertical position without the aid of an ancillary device, such as an inner tube made of the same or similar plastic or a coil spring. This problem is exacerbated when a sign panel is secured to the post.

Moreover, posts constructed with inner tubes often are configured with the inner tube fixed, engaged or fastened in some way to the outer tube or anchor system as shown for example in U.S. Pat. No. 4,522,530. Also, prior art posts made of polyethylene materials are incapable of returning to vertical when substantial weight is added to them, such as sign panels, even with the presence of an inner tube.

In prior art post system disclosed in U.S. Pat. No. 5,518,337, the post is mounted using a horizontal pin, e.g., 5/16 inch diameter. This mounting method is adequate for a single, stand-alone, flexible post and has proven to withstand hundreds of high-speed impacts from a moving vehicle. However, the mounting system may be inadequate when substantial weight is added to the post system, for example by way of sign panels, due to the excess load and accompanying forces experienced during vehicle impacts. One problem is the lack of surface area that the pin makes contact with at the post anchoring area. For example, in one prior art system, the pin only contacts a roughly 0.2 square inch area at the anchor location. Accordingly, the need remains for a more robust, but low cost, sign post system.

SUMMARY

Briefly stated, a delineator sign-post system includes a rebound mechanism that self-rights the post to a vertical position after an impact by a vehicle. In one embodiment, the rebound mechanism includes an inner elastomeric (rebound assist) member disposed inside an outer elastomeric member, configured as a hinge tube in one embodiment. In one preferred embodiment, the inner elastomeric member rests freely inside the lower portion of the outer cylinder without the need of a retaining device such as cables, fasteners or a friction fit. In one embodiment, the elastomeric member removably rests on top of a bottom portion of the hinge tube, or an anchor member, and is positioned entirely above ground, and below any fasteners securing the hinge tube to an outer post, which can be configured to hold a sign panel. In one embodiment, the hinge tube is more flexible than the outer post.

In another aspect, a self-righting post assembly includes a hinge tube having an interior cavity, an elastomeric inner member separate from the hinge tube and disposed in the interior cavity of the hinge tube, and a base adapted to be secured to a mounting surface. A fastener connects the hinge tube to the base. Preferably, the fastener has a vertical orientation. In one embodiment, an extension post is coupled to the hinge tube. A method of assembling a self-righting post assembly is also provided.

The various embodiments provide significant advantages over conventional post systems. For example and without limitation, the post assembly is easy to assemble. In one embodiment, the inner member can simply be disposed in the hinge tube without the use of any fasteners, thereby making the assembly more robust. The vertically oriented fastener also improves the overall strength and durability of the system. In addition, by making the extension post separate from and more rigid, or less flexible, than the hinge tube, the post is capable of holding a heavier sign panel, while the hinge tube and inner member provide a self-righting mechanism capable of returning the heavier (and top-heavy) assembly to a vertically erect position.

The foregoing paragraph been provided by way of general introduction, and are not intended to limit the scope of the following claims. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

Figure 1:
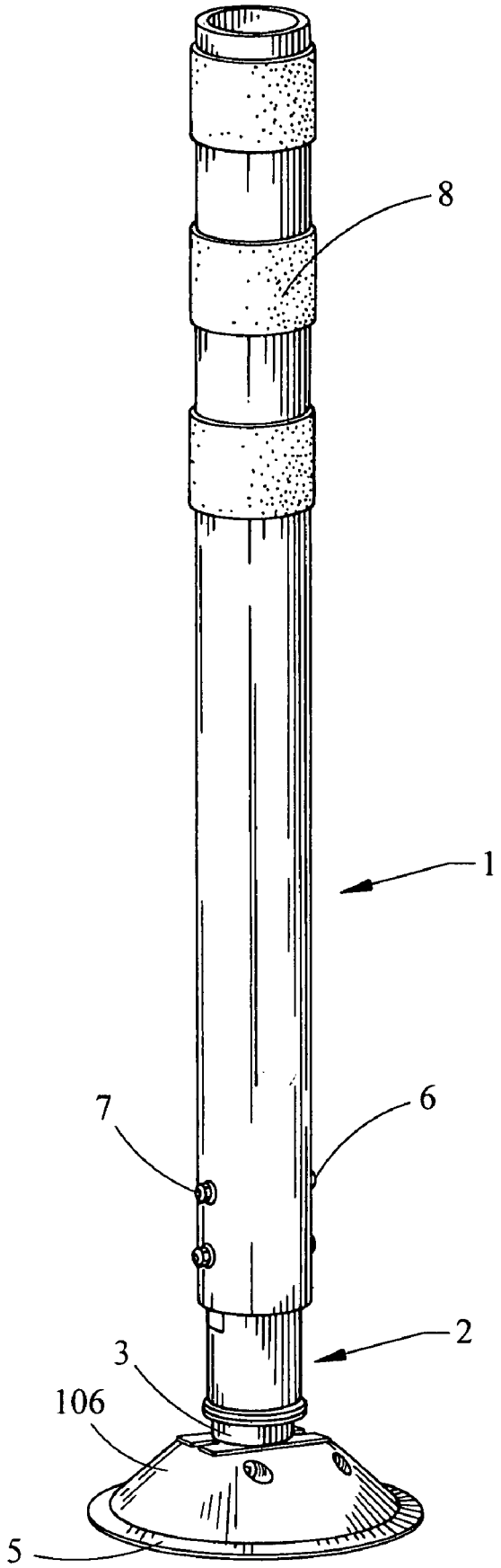
FIG. 1 is an isometric view of delineator post in a surface mount base.
Figure 2:
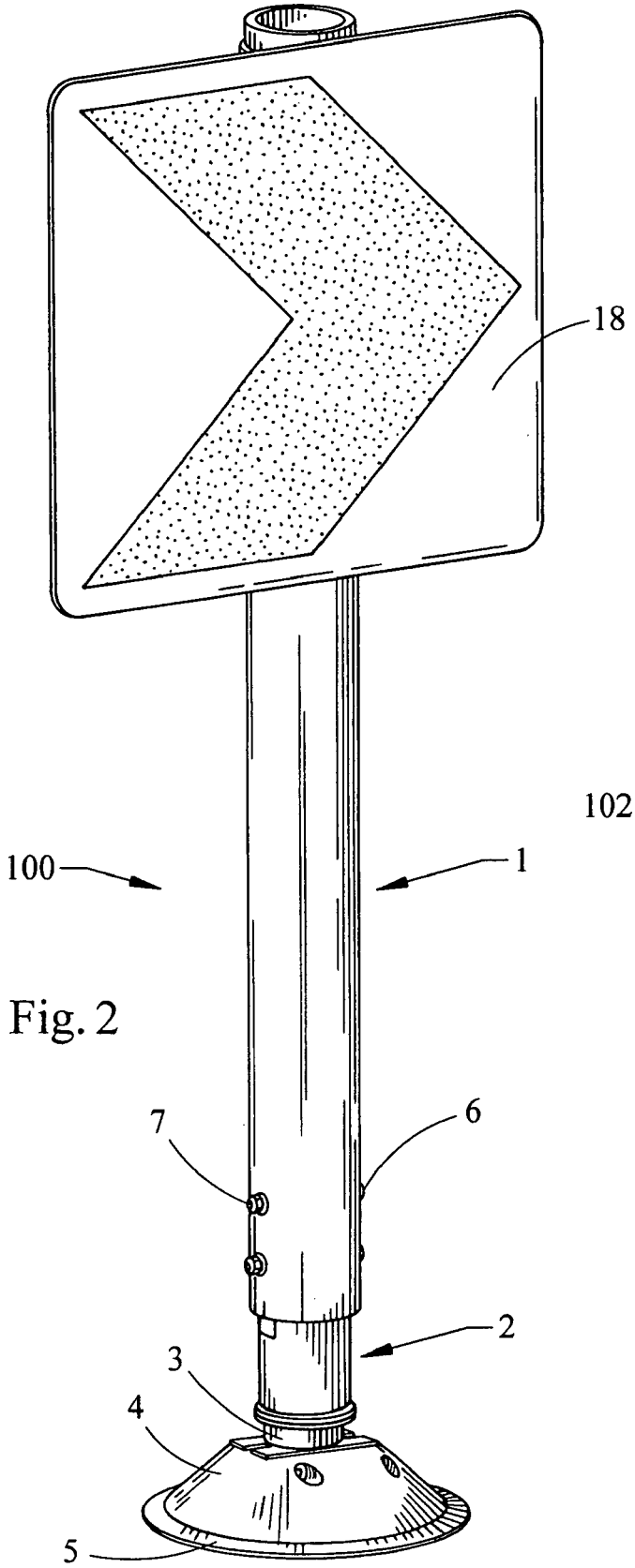
FIG. 2 is an isometric view of the delineator with a traffic sign in a surface mount base.
Figure 3:
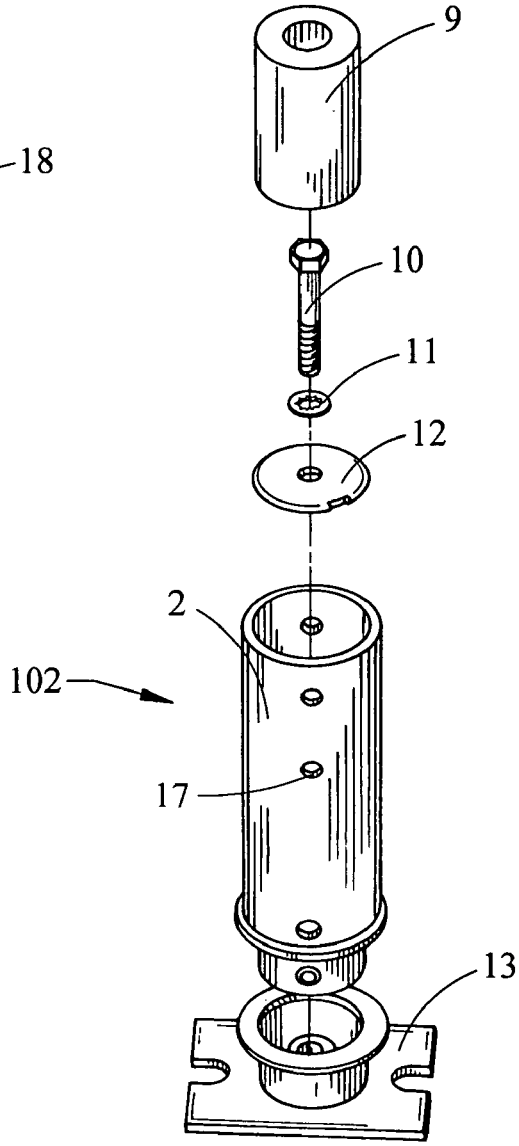
FIG. 3 is an exploded view of the hinge tube and its related parts with a surface mount socket.

Referring to FIGS. 1-13, a delineator sign post system 100 includes a rebound mechanism 102 that self-rights a post assembly to a vertical position when impacted by a vehicle. The rebound mechanism 102 includes an inner (rebound) elastomeric member 9 disposed inside an outer elastomeric tube 2, referred to as a "hinge tube" since it has the ability to bend about a hinge axis oriented substantially perpendicular to the longitudinal axis of the tube. In this way, any tube that is configured to bend is a hinge tube. The term tube refers to a hollow member, or a member having an interior cavity that can be, but is not necessarily, formed through an entire length thereof.

In one embodiment, the elastomeric inner member 9 and hinge tube 2 are formed as cylinders, although other shapes are also suitable. For example, it should be understood that the tube and inner member can be cylindrical with a circular cross-section, or can have other cross-sectional shapes, such as elliptical, oval, obround shapes, and/or various polygonal cross-sectional shapes including without limitation various rectangular, square, triangular and diamond shapes. In addition, the inner member can be made solid all of the way through. The tube may also be configured with different shapes and cross-sectional areas at different locations along its length. In addition, the inner member can be formed integrally as part of the hinge tube, for example by thickening the walls of the hinge tube along the portion where the inner member would be positioned. In another embodiment, the inner member is formed as a plurality of longitudinally extending ribs (see, e.g., FIG. 11) that extend radially inward from an inner surface of the hinge tube. In these various embodiments, the inner member, whether formed as a separate member or integrally with the hinge tube, help prevent the hinge tube from collapsing during an impact.

In one embodiment, the inner elastomeric member 9 rests freely inside the lower portion of the outer hinge tube 2 without the need for a retaining device such as cables or fasteners, although such devices can be used. Also, in one preferred embodiment, the inner member 9 has an outer diameter slightly smaller than the inner diameter of the outer hinge tube 2 such that the inner member 9 does not frictionally engage the outer hinge tube. As shown in the embodiment of FIG. 1, an outer post 1, referred to as an extension tube, is disposed over and secured to the hinge tube 2.

In one embodiment, one or both of the hinge tube and extension tube are formed with tapered walls as shown in U.S. Pat. No. 5,518,337, the entire disclosure of which is hereby incorporated herein by reference. The addition of an elastomeric rebound member inside an outer post or tube 1, 2 at the flexing area of the outer tube 2 or post, prevents the walls of the outer post from collapsing while still allowing the outer tube 2 to flex. While it is preferred that the extension tube 1 is separate from and disposed over the hinge tube 2, in one embodiment, the extension tube and hinge tube are integrally formed as a single post member. In another embodiment, the extension tube has a lower end disposed inside the hinge tube, for example in an interior cavity of the hinge tube above the inner member.

The flexible hinge tube 2 is preferably made of urethane rubber, which, by its nature is a flexible elastomer with excellent memory properties. Other suitable materials include thermoplastic elastomers (TPE), including for example and without limitation nylon, etc. The inner rebound member 9 can be made of the same materials, including for example and without limitation ethylene propylene diene monomer (EPDM), Neoprene, Urethane and in general soft TPE. The extension tube 1 is preferably more rigid, or less flexible, than both the hinge tube 2 and the inner member 9. The terms "flexible" and "flexibility" as used herein mean capable of being bent in response to the application of a force, with a component being more flexible if it is more easily bent, for example in response to a lesser force, than another component. For example, two tubes of equal length held at one end in fixed configuration (cantilevered) have different flexibilities (whether due to the material of the tube, the cross-sectional properties, etc.) if one tube is more easily bent in response to the application of equal forces being applied equidistance from the fixed ends of the tube. In other words, the more flexible tube is more easily bent in response to a particular moment being applied thereto. In one preferred embodiment, the hinge tube is more easily bent than the extension tube in response to the application of a force, such that the assembly of the extension tube and hinge tube bends the hinge tube in response to the application of a force applied to the end of the extension tube.

The top of the delineator extension tube 1 can be configured with various indicia, including reflective members or bands 8 as shown in FIG. 1. Alternatively, a sign 18, 22 configured separately from the extension tube, such as a traffic sign (e.g., stop sign) or other information sign having indicia, can be secured to the post 1, for example at the top thereof (sign 18—FIG. 2) or along the length thereof (sign 22—FIGS. 7 and 8). In other embodiments, the signs can be integrally formed with the extension tube. Signs 18, 22 of this configuration can make the post relative top heavy, and therefore ideally suited for a rebound member. In one embodiment, shown in FIG. 8, the sign panel is configured with a reflective sheeting 26. In various embodiments, the width of the sign is greater than the width of the post, regardless of whether the sign is separately from and coupled to the post, or formed integral therewith. For example, in one embodiment, the sign as a width at least two times the width of the post. In one embodiment, the sign has a width of eight inches, while the post has a width (diameter) of three inches. In other embodiments, the sign has a width at least three times the width of the post, at least four times the width of the post, at least five times the width of the post, and at least six times the width of the post, at least seven times the width of the post and at least eight times the width of the post (e.g., a twenty-four (24) inch wide sign mounted on a three (3) inch post).

Figure 10:
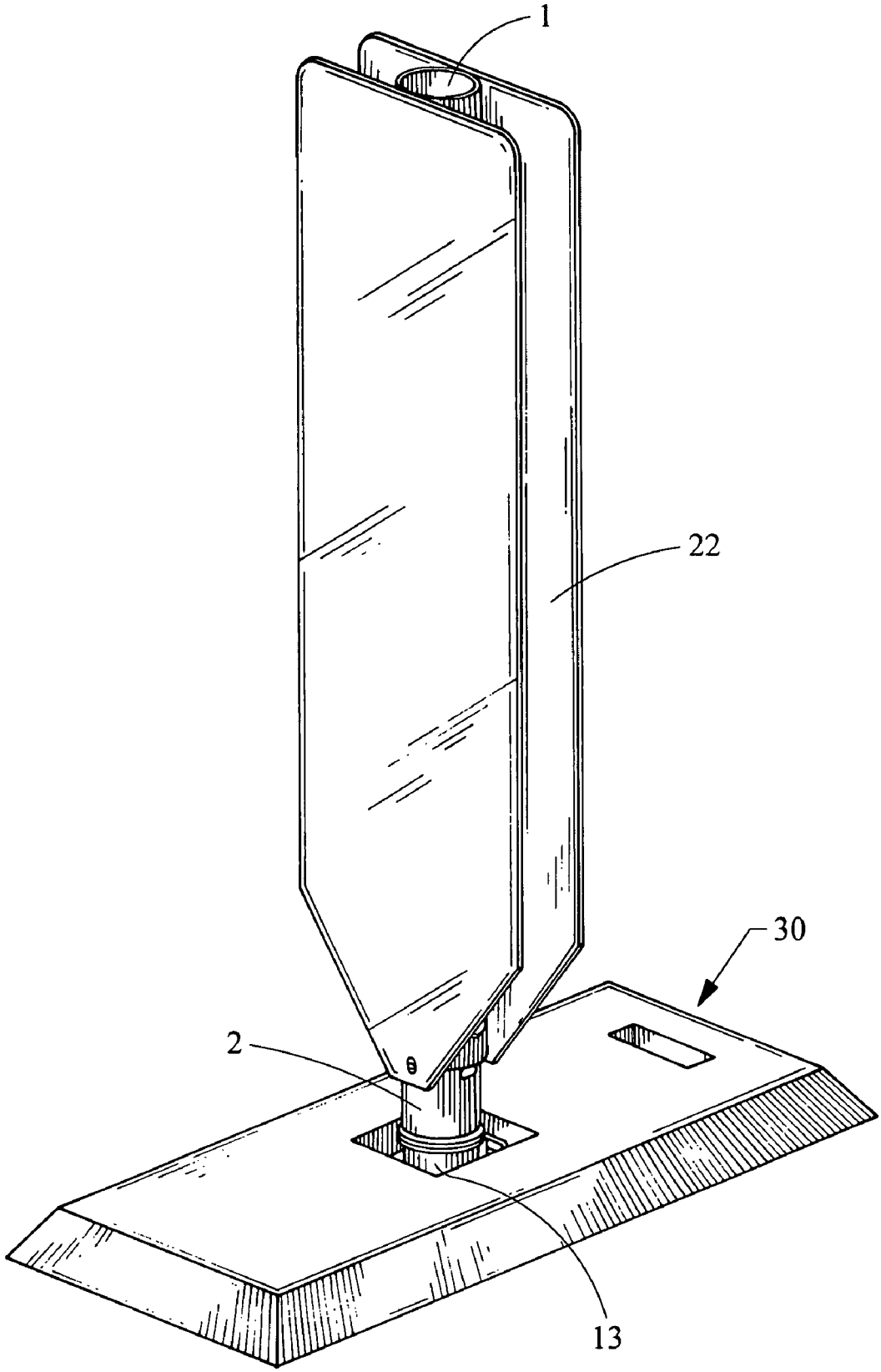
FIG. 10 is an isometric view of the delineator mounted in a portable base.
Figure 13:
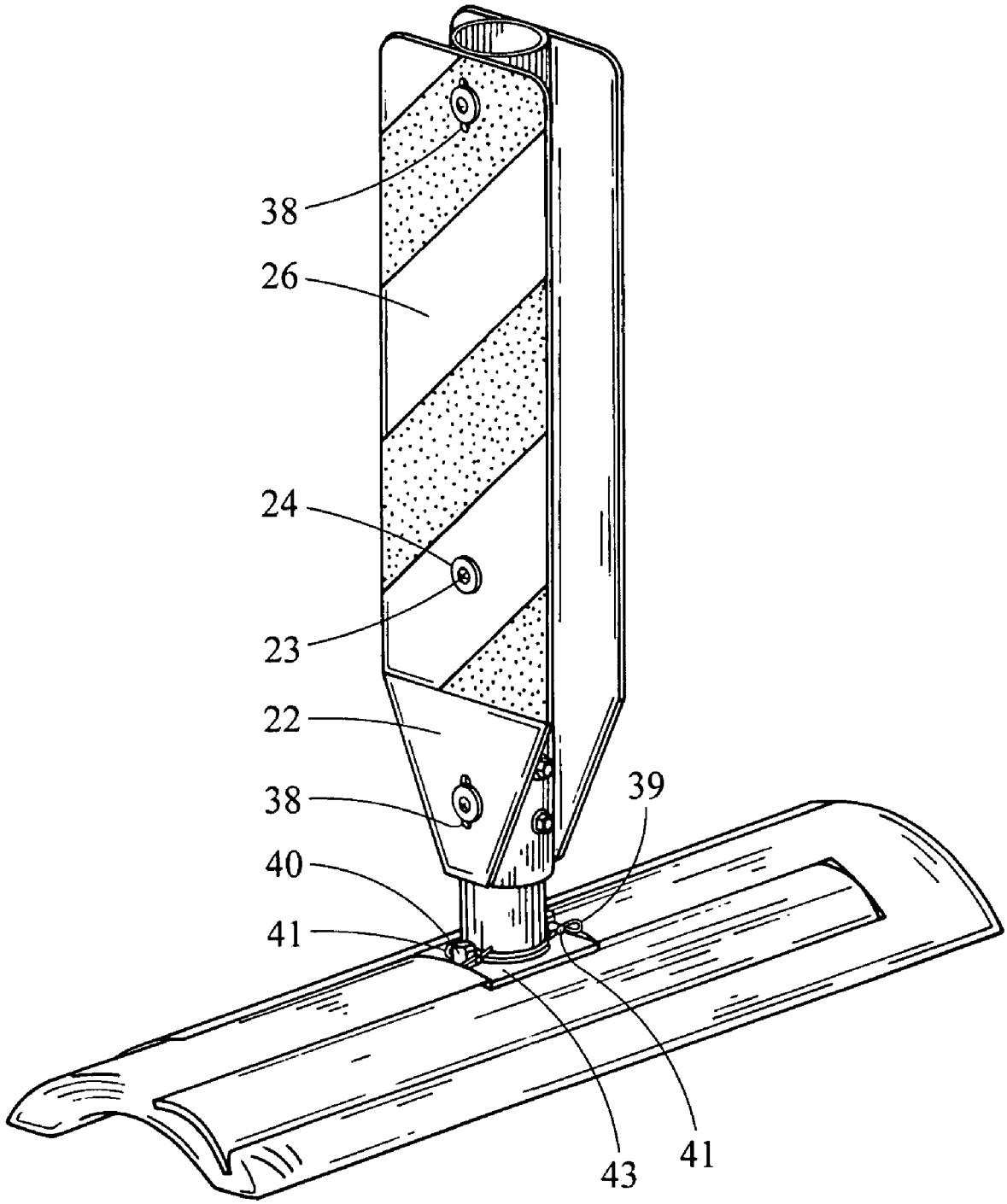
FIG. 13 is an perspective view of an embodiment of a delineator mounted on a curb.

In one embodiment, the inner elastomeric rebound member 9 is not fastened or otherwise secured to any other member. Rather, the rebound member 9 is simply inserted inside the outer tube 2 until it rests on a bottom of the outer hinge tube, for example on a shoulder or other anchor mechanism such as a washer 12 as shown in FIGS. 3-7. In this way, the rebound member can be easily and quickly inserted to supplement the rebound characteristics of the post, for example when it is configured to hold a sign. As such, a single thickness outer tube, e.g. hinge tube (with or without an additional upper extension post) can be made to function as a less robust delineator, or as a more robust sign post, without having to modify the outer/hinge post by increasing its thickness etc. The post assembly, with or without the inner member, can be secured to or in the ground in a variety of ways, including a surface mount (FIGS. 4 and 7), a subsurface mount (FIG. 6), a ground spike anchor 28 (FIG. 9) or a curb mount (FIG. 13). The post assembly can also be made portable, as shown in FIG. 10.

Figure 4:
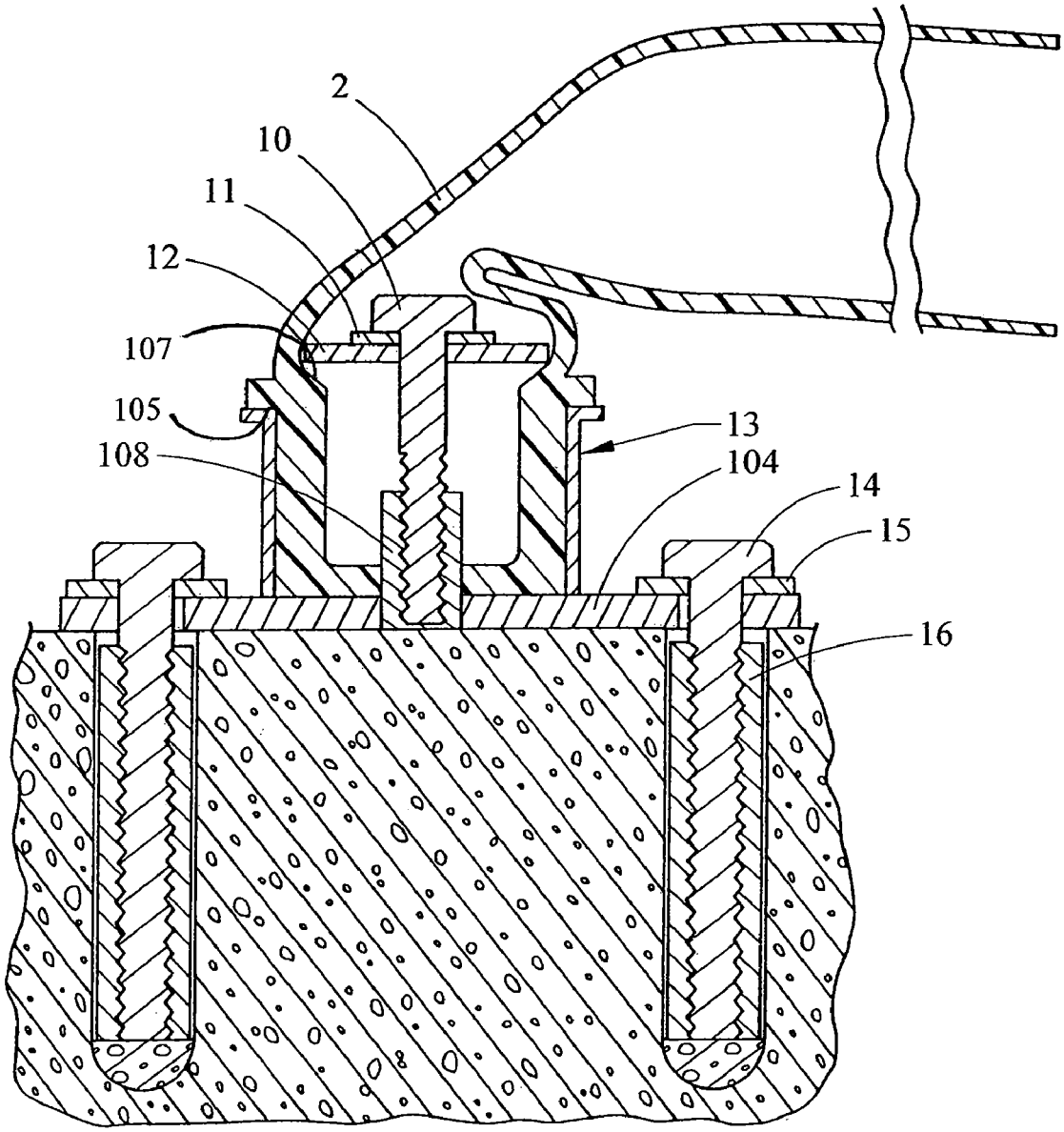
FIG. 4 is a cross-sectional view of the hinge tube collapsing without presence of the inner elastomeric member.
Figure 5:
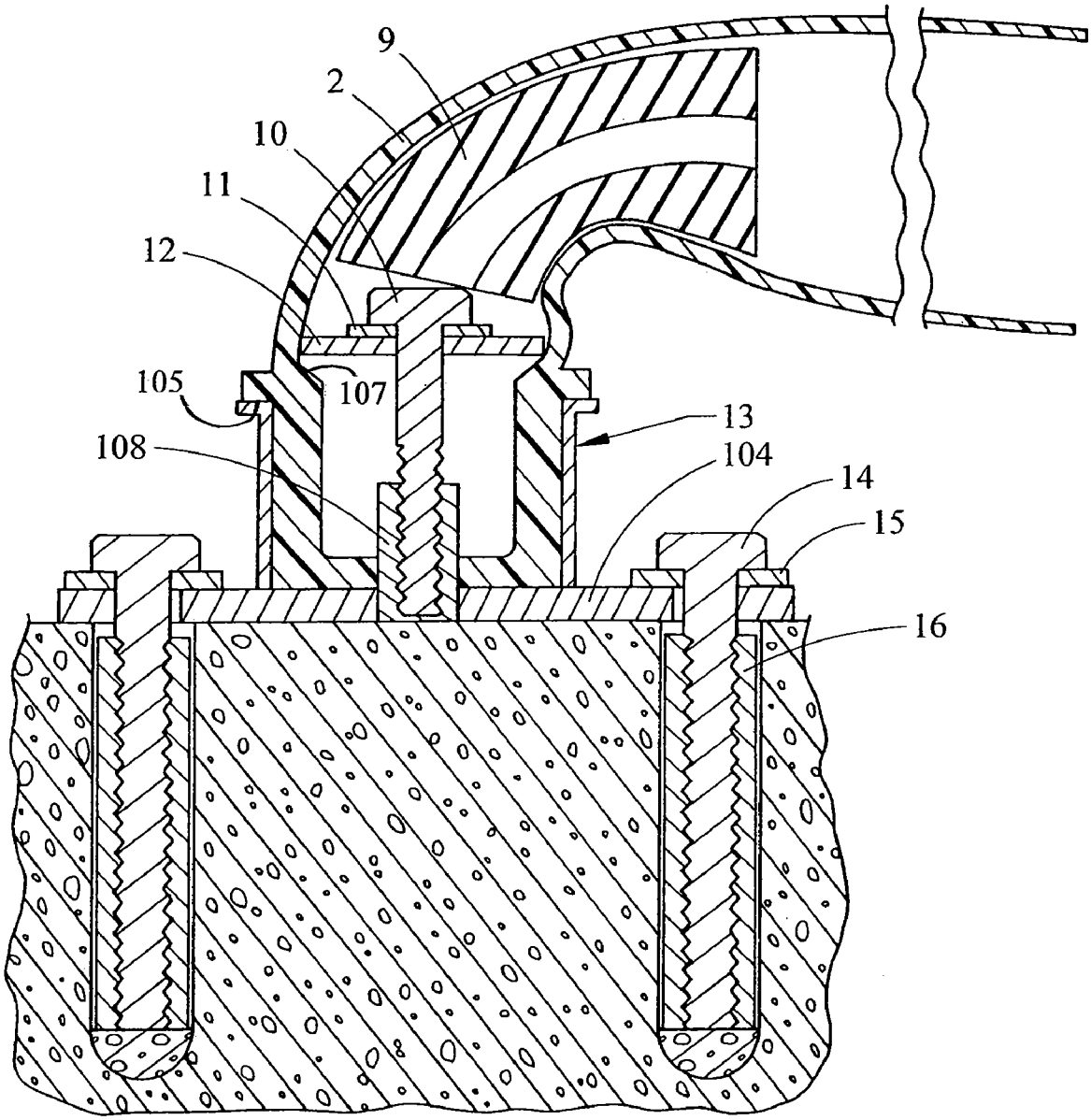
FIG. 5 is a cross-sectional view of the hinge tube with the inner elastomeric member disposed therein.

For example, a hinge tube fastener 10, shown as a bolt, secures the hinge tube 2 to a base or anchor, such as a plate 104 or base 106, made for example from plastic or metal (FIGS. 4, 5, 7, 8), with the washer 12 defining a clamping member that engages an interior shoulder defining an upper clamping surface 107 on the hinge tube 2. The fastener 10 and plate/base can be integrally formed as a one-piece unit. A lag screw 14, in combination with a washer 15 and lock washer 27, secure the base 104, 106 to a lag shield 16 inserted in the ground, or can directly engage the ground or other mounting medium. A mounting socket 13 can be inserted in the base 106 as needed to receive the mounting bolt 10, while a lock washer 11 can be used with the bolt 10 to prevent loosening due to vibrations. In the embodiment of FIG. 4, a mounting socket 13 is disposed on top of the mounting plate 104 and receives the lower end of the hinge tube 2, and engages an exterior shoulder defining a lower clamping surface 105 on the hinge tube 2. A bolt receptacle 108 is secured to one or both of the plate 104 and socket 13. The fastener 10, together with the washer 12 and mounting socket 13, clamp the hinge tube between the upper and lower clamping surfaces 107, 105. In the embodiment of FIG. 10, a portable base 30 is shown. As shown in FIG. 1, an adhesive 5, such as an epoxy, can be used to secure the base 106 to the ground.

Figure 6:
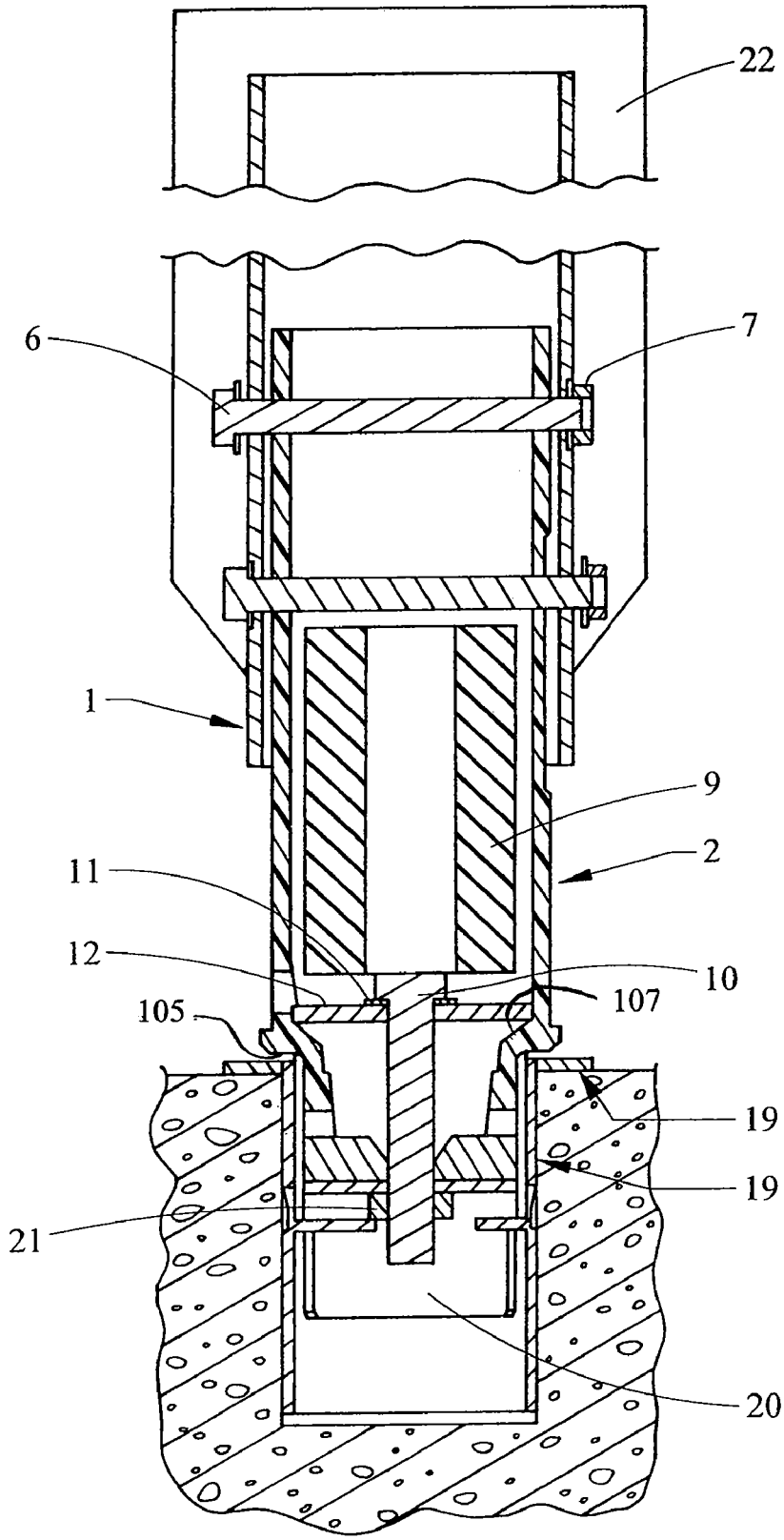
FIG. 6 is a cross-sectional view of the delineator with a traffic sign mounted in a subsurface mounted base.
Figure 7:
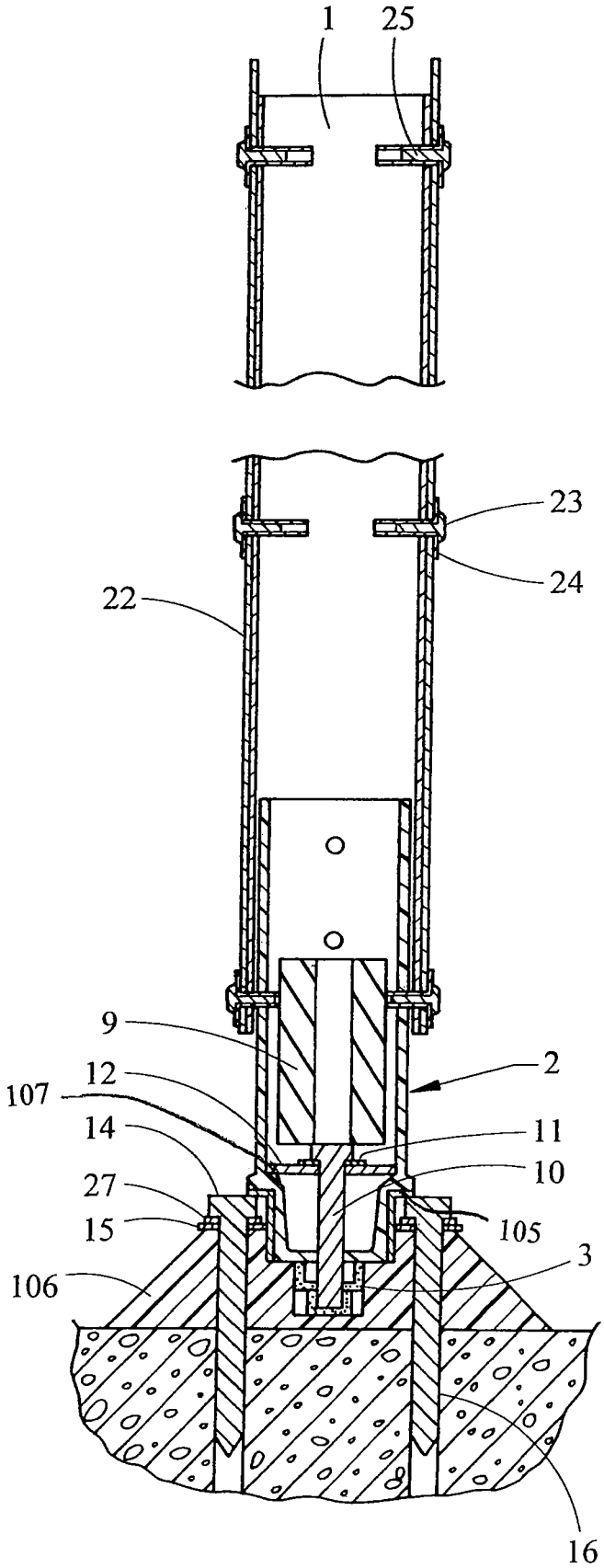
FIG. 7 is a cross-sectional view of the delineator with double traffic signs mounted in a plastic surface mount base fastened to the ground with lag bolts.
Figure 8:
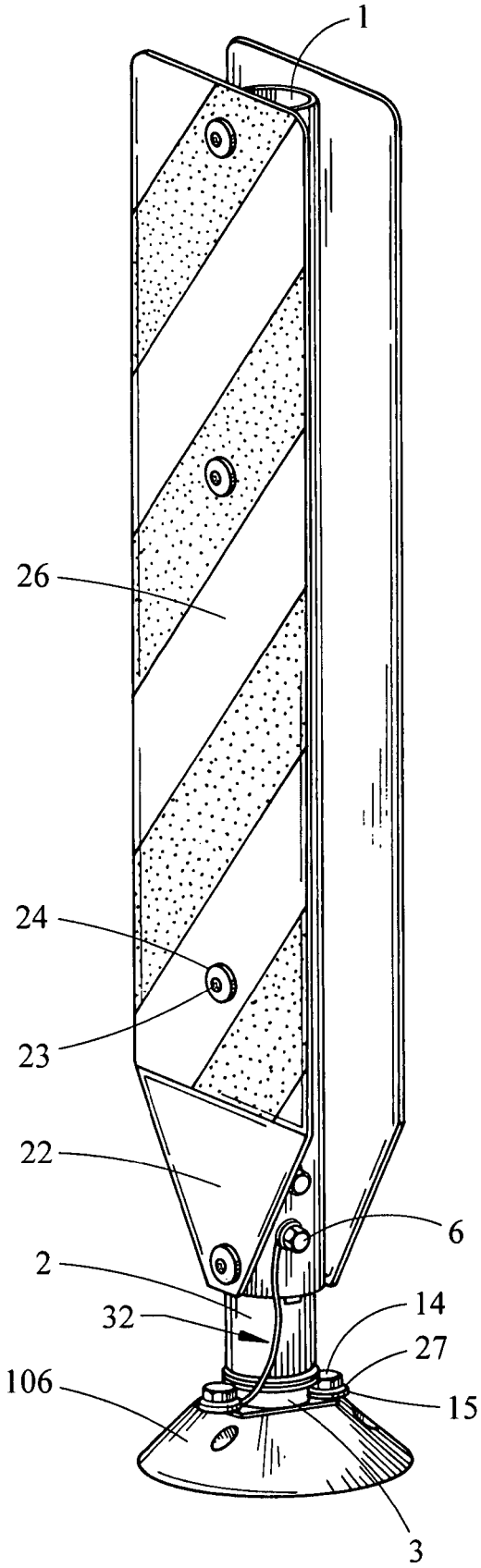
FIG. 8 is an isometric view of the delineator with double traffic signs mounted in a plastic surface mount base fastened to the ground with lag bolts.
Figure 9:
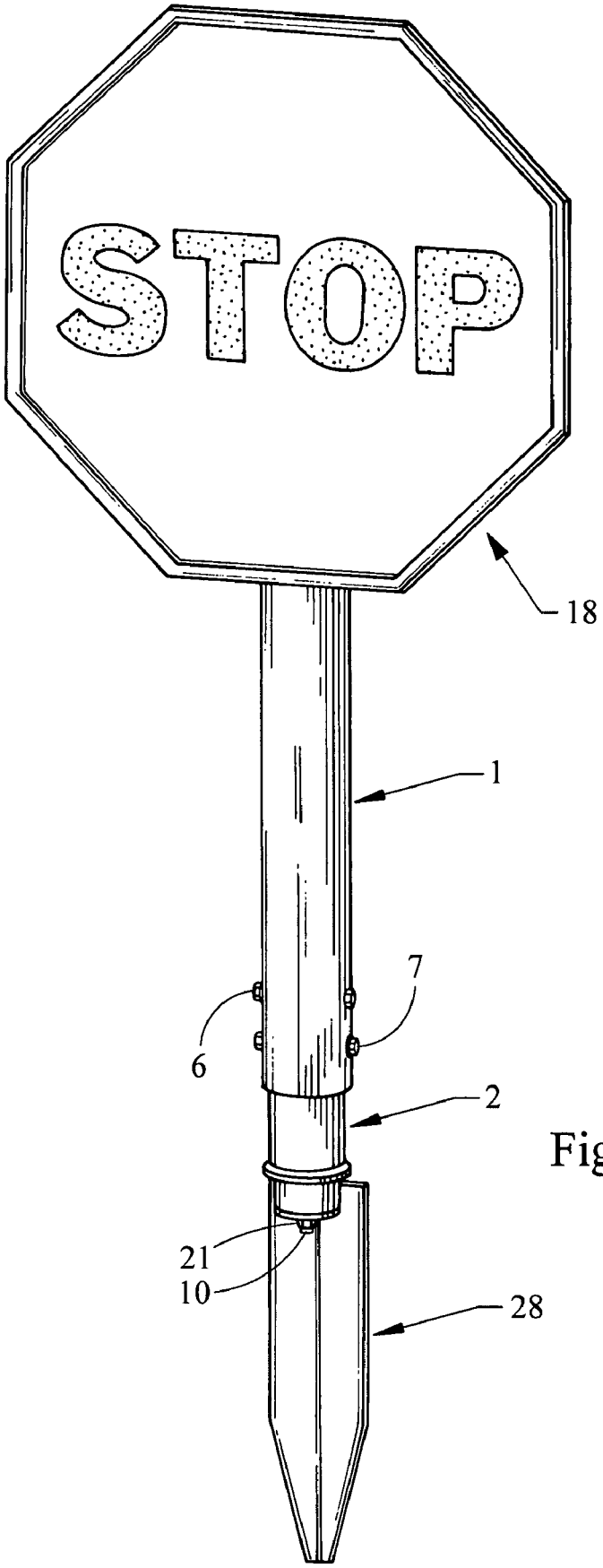
FIG. 9 is an isometric view of the delineator with a traffic sign mounted in a ground spike anchor.

In another embodiment shown in FIG. 6, a subsurface outer sleeve 19 is disposed in the ground, with a subsurface mount inner tube 20 secured to the outer sleeve 19. The lower end of the hinge tube 2 is secured to the inner tube 20 with a bolt 10, washers 11, 12 and a nut 21. As shown for example in FIG. 8, a tether 32 can be incorporated to secure the post to the base 106 such that the post does not become airborne if one of the connectors fails during an impact.

Referring to FIG. 13, a base plate 43 is disposed over a pair of mounting studs 40, with removeable locking pins 41 (including removeable pins 39) secured through openings formed in the studs to provide a quick-release mechanism.

In all of these embodiments, the inner member 9 is disposed above the mounting surface, such as the ground, but below any fasteners 6, 7, including for example a nut and bolt, securing the extension tube or post 1 to the hinge tube 2. A mounting hole 17 is provided in the hinge tube 2 to receive the bolt 6, which passes through the extension tube 1. In one embodiment, shown in FIG. 7, additional fasteners 23, 24, including a washer and screw, secure the sign panel 18, 22 to the outer extension post 1, and also to the hinge tube 2, below the top of the inner member 9, although other fasteners 6, 7 secure the hinge tube 2 to the extension post 1 above the inner member 9. Other fastener devices, such as an adhesive, can be used to secure the sign panels to the extension tube, and/or the extension tube to the hinge tube. Alternatively, the extension tube can be coupled to the hinge tube by way of a friction fit, snap fit or other securement methods. A threaded insert 25, shown in FIG. 7, can be inserted to threadably receive the screw 23. In any of these embodiments, the inner member 9 can be easily and simply installed simply by removing the extension tube or post 1, disposing the inner member 9 in the hinge tube 2 and reinstalling the extension tube or post 1. In some embodiments, the hinge tube 2 and extension tube or post 1 are formed as a single, integral tube, with the integral tube being referred to as a hinge tube due to its ability to pivot or rotate about a "hinge axis." In this embodiment, the inner member 9 is simply disposed through the top of the hinge tube.

The inner elastomeric member 9 acts as a space filler which prevents the outer walls of the elastomeric cylinder, or hinge tube 2, from collapsing when the extension tube or post 1 is moved over to an angle, for example, approximately >45° from vertical. Without the inner elastomeric member 9 for support, testing has shown that if the outer hinge tube cylinder 2 collapses, then the cylinder mechanical properties are compromised and the post loses the ability to right itself to a vertical position when additional weight is attached to it. In addition to preventing the outer cylinder walls of the hinge tube 2 from collapsing, the elastomeric properties of the inner member 9 act as a spring, which further helps in bringing the post to a vertical orientation on its own accord. The nature of the outer post, or hinge tube 2, and inner member 9 being of cylindrical geometry allows the post to right itself when impacted from a vehicle from any angle on the horizontal plane. Of course, the inner and outer members 2, 9 can be configured in other non-cylindrical shapes.

The signpost/delineator system can be "tuned" for a variety of applications. Varying the diameter of the inner elastomeric member 9 and varying the Durometer properties of the elastomeric material provides the user with the ability to adjust the force required to lift the post to vertical and, thusly, right itself when its overall weight increases due for example to the addition of sign panels. For example, the inner member 9, when configured as a tube, can have an inner diameter from about ½ inches to about 2 inches, with an outer diameter ranging from about 1 inch to about 2½ inches. The inner member is from about 2 to about 6 inches long, and in one embodiment about 4 inches. The Durometer of the inner member ranges from about 50 to 80 Shore A. In other embodiments, the inner member 9 is not a tube at all, but rather is solid throughout, having an outer diameter of from about ½ inches to about 2 inches. Varying the inner diameter and outer diameter dimensions of the elastomeric member would affect the force needed to return the post to a vertical position. The cross-sectional shape and area of the inner member can also be altered as desired.

The elastomeric inner member 9 preferably has an outside diameter approximately 50% to 58% of the hinge tube 2 outside diameter, or in one embodiment from about 57% to about 67% of the inner diameter of the hinge tube 2. These ratios allows the hinge tube 2 to partially collapse on the inner member 9 when the signpost system is bent over. The action of the hinge tube 2 partially collapsing prevents excess stress on the hinge tube wall and relieves stress on the mounted portion of the signpost system. Excess stress in the flexing section in the outer wall of the hinge tube 2 can result in stress transferred to the mounted section of the signpost system, which can shorten the life of the product due to fatigue. If a larger diameter elastomeric inner member 9 is used, for example, one of 70% to 85% diameter ratio, the partial collapse of the hinge tube is avoided as the signpost is flexing, thereby causing excess stress on the section of hinge tube 2 that is in contact with the inner member 9. This excess stress can lead to plastic deformation of the hinge tube 2, thereby reducing its serviceable life.

The elastomeric inner member 9, when configured as a tube, preferably has a wall thickness ratio of approximately 20% to 28% of the inner member 9 outer diameter. Inner member 9 dimensions within this ratio range allow the inner member tube to partially collapse, yet provide adequate support for the desired flexing characteristics of the signpost system.

Figure 11:
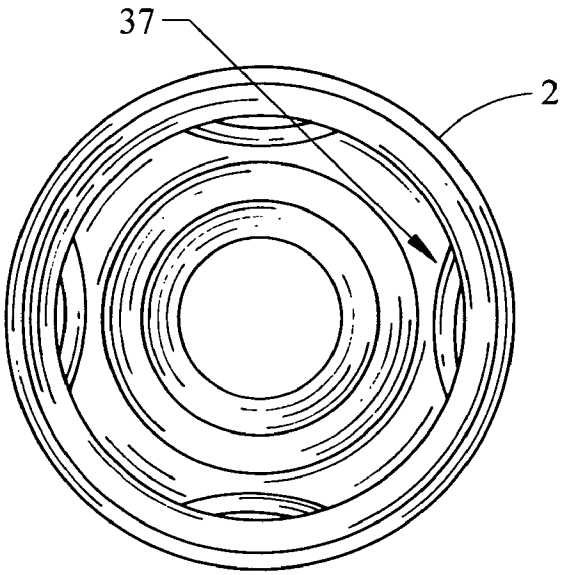
FIG. 11 is a cross-sectional view of the hinge tube with integrated stiffening ribs.

An alternate method of retaining structural integrity of the hinge tube, 2, during bending (i.e. preventing the tube walls from collapsing) is to integrate geometric features into the walls of the hinge tube such as ribs 37, an example of which is illustrated in FIG. 11. Integration of ribs into the hinge tube walls eliminates the need for a separate member as already discussed at length in the accompanying paragraphs. The ribs stiffen the hinge wall at critical areas providing the necessary stiffness required to maintain the self-righting properties of the elastomeric hinge mechanism. The ribs are integrally formed from the same material as the hinge tube during the manufacturing process such as injection molding. Other manufacturing methods could be used to incorporate rib features into the hinge tube, for example, but not limited to extrusion, casting or machining.

One example of the rib cross-section profile is illustrated in FIG. 11. The ribs 37 are tapered, meaning they have a larger cross-section profile at the lower section and gradually transition to a smaller cross-section profile at an upper section. The tapered rib profile provides the hinge tube 2 with varying stiffness along its long axis which would offer greater stiffness at the lower portion of the hinge tube while gradually lessening the stiffness towards the upper portion of the hinge tube 2. In another embodiment, the hinge tube ribs 37 would not be tapered, rather they would have a consistent cross-section along their entire length, which may extend along the entire or a portion of the length of the hinge tube.

The rib 37 shown in FIG. 11 is a half-round shape with the outer convex surface oriented towards an inner section of the hinge tube. However, the rib cross-section could be one or a combination of a plethora of shapes other than circular shapes, including but not limited to include rectangular, elliptical, triangular or trapezoidal, to name a few. As shown in FIG. 11, four ribs 37 are shown as achieving the desired mechanical properties of the hinge tube as discussed beforehand. However, a wide multitude of the number and shape of the ribs 37 could be used to achieve the same result. For example, two or three larger cross-sectional ribs would serve to prevent the hinge tube walls from collapsing, while a larger multiple, say six or eight or twelve smaller cross-sectional ribs would function to support the hinge tube walls.

Figure 12:
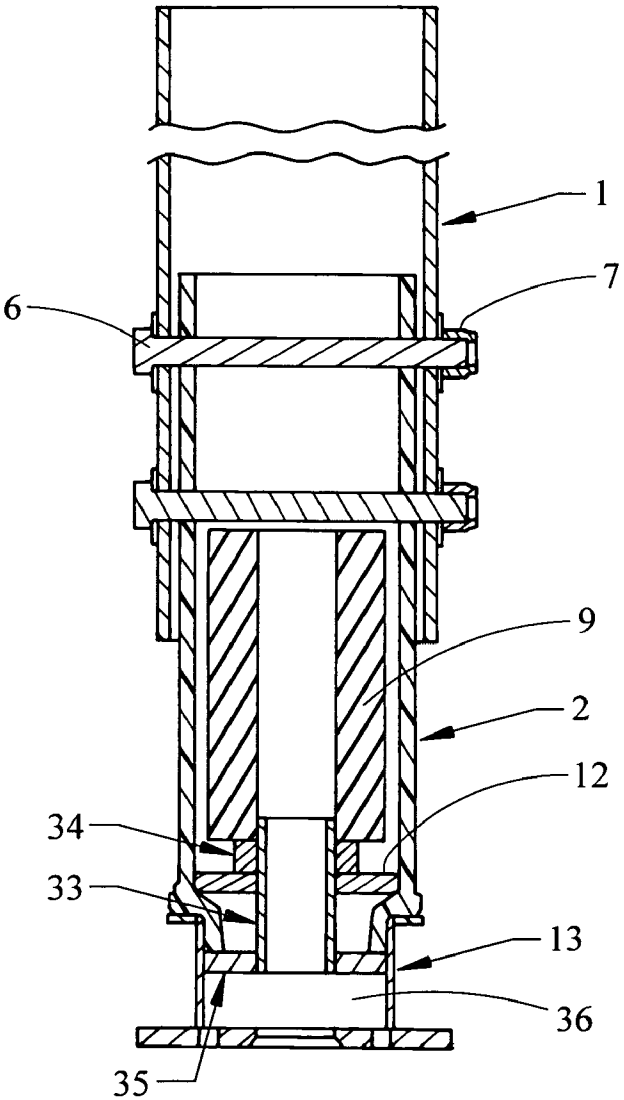
FIG. 12 is a cross-sectional view of the hinge assembly showing a pass-through between the base and post of the delineator.

Referring to FIG. 12, which shows a cross-section view of one embodiment of the hinge assembly disposed within a hollow sleeve 33, which functions as a hinge tube fastener. The sleeve 33 includes a hollow or cavity formed therethrough to allow for pass-thru of various things, for example, wires to supply power to a light mounted above. The hollow fastener 33 is a strong rigid material such as a steel pipe or threaded steel tube. The lower end of the hollow fastener 33 is fixed by threading or welding (or other adhesives/bonding) to a support plate 35, preferably steel or other metal, which is attached to the socket 13. A nut 34 threadably engages the upper portion of the hollow fastener 33 and secures in place the hinge securing washer 12. In this version, the mounting socket 13 contains a cavity 36 to allow for placement of batteries, wires or electronic components to power, for example, one or more lights mounted on the delineator above, for example to one or both of the extension post 1 or sign panel. The lights can be convention or LED and can directly or backlight the signage, and/or can provide changeable messages etc.

Importantly, and as noted above, the hinge tube 2 walls are preferably tapered, as disclosed in U.S. Pat. No. 5,518,337, which is hereby incorporated herein by reference.

Another unique aspect of the signpost system is the use of the extension tube 1 fastened to the flexible hinge tube, or other intermediate flexible member. The extension tube 1 is an extruded cylinder made from a plastic, such as polypropylene and can vary in length anywhere from 36 inches to 72 inches. The inside diameter of the extension tube 1 is slightly larger than the outside diameter of the hinge tube 2. The extension tube 1 fits over, approximately, the top 3 to 4 inches of the hinge tube 2 and is fastened in place with bolts and nuts as described above. The wall thickness of the extension tube 1 is approximately 5% to 7% of the extension tube 1 outer diameter. The sign panels 18, 22 are fastened to the extension tube 1 with screws and nuts as described above. One advantage of using an extension tube 1 to hold the signs 18, 22 is that the sign panels are separated from the flexible coupling, thus allowing the extension tube 1 to remain relatively straight during an impact from a moving vehicle. Testing has shown that sign panels fastened directly to the flexible hinge tube 2, which is elongated, can separate prematurely from the system. Another advantage of using a relatively rigid extension tube 1 to hold the signs 18, 22 is the ability of the rigid plastic to retain a fastener 23 under dynamic load. In contrast, the softer, more flexible plastic of the hinge tube 2 does not support the fasteners as well as the extension tube 1 given the nature of the forces exhibited on the system during an impact by a vehicle. Of course, it should be understood that the hinge tube 2 and the extension tube, including any signs secured thereto, can be integrally formed as a one-piece unit. In this way, it should be understood that the term "secured" refers to two or more items (whether separate or integral) being connected, whether by fasteners, bonding, interference fit, integral molding, etc. It should also be understood that the extension tube can have a variety of cross-sectional shapes as described above, or may be made as a solid post.

The post system is intended to support a wide variety and multiple of signs, vertical panels and other indicia while retaining its self-righting properties. For example two ⅛ inch×18 inch×42 inch plastic panels 18 weighing 3.5 lbs each could be fastened to the post system on opposing sides of each other to provide indica to roadway traffic in two directions. The panel is positioned on the extension tube so that it is centered on the long axis and the top of the panel is adjacent to the top of the extension tube. In another example, a ⅛ inch×24 inch×24 inch octagonal shaped sign 18 weighing 2.5 lbs is fastened at the upper end of an extension tube 1 having a length of about 72 inches. In yet another example, four panels of dimensions 12 inches×42 inches and 2.4 lbs each are fastened to the extension tube of the same length with the panels at 90° angles to each other. As set forth above, it should be understood that the sign panels can be integrally formed with the extension tube as a one-piece unit, or that the hinge tube, extension tube and sign panels can all be integrally formed as a one-piece unit. In one embodiment, a box can be molded at the top of the extension tube, for example to hold one or more lights or power sources, e.g., batteries.

Testing has shown that the sign panel life is extended when slots 38 are used in place of holes at the fastening locations as illustrated in FIG. 13. A round hole is provided in the center section of the sign panel and fastened securely with a screw 23 and washer 24 to keep the sign panel in its relative position on the post. The outboard sign connection openings 38 (shown as top and bottom) are slotted which allow the sign panel to slide freely on the fasteners and greatly improves the life of the sign panel by preventing it from binding and tearing at the screw fastening locations as the delineator flexes and bends when impacted by a moving vehicle. It is necessary to install the screws at the slotted opening locations so that the washers make minimal contact with the sign panel surface to allow the sign panel to slide on the washer with minimal friction. The slot opening 38 geometry is such that its width is at about 25% greater than the width (diameter) of the fastening screw and its length is about 8 times greater than its width. The relative position of the fastening screw with the slot opening is approximately in the center of the slot opening when the delineator/sign panel assembly is at rest in its vertical position. This allows approximately equal travel of the slot opening around the fastening screw when the delineator is flexed in any direction.

The signpost mounting system allows for the ability of the post to function over repeated impacts from a vehicle traveling at slow to medium rates of speed, such as 15 to 45 mph. The robust mounting system provides adequate support for the tremendous load forces that the post system experiences while in service. Instead of a small diameter pin securing the post in a horizontal orientation, the robust support preferably includes in one embodiment a ½ inch diameter bolt 10 of high-grade steel, engaging a large diameter steel washer 12, positioned in a vertical orientation along the longitudinal centerline of the post 1, 2 and system. In one embodiment, the washer 12 is 3/16 inch thick steel and has an outside diameter that is slightly smaller than the inside diameter of the hinge tube 2, such that it substantially fills the inner circumferential area of the hinge tube. Of course, the washer 12 can be configured in other non-circular shapes to mate with corresponding non-circular shapes of the cavity of the hinge tube. One edge of the steel washer rests on a flange on the inside of the hinge tube 2. The ½ inch bolt fits through the hole in the center of the washer and secures the hinge tube to the mounting socket. This anchoring method provides a contact surface area that is five times greater than the horizontal pin anchoring method of the prior art. A lock washer 11 between the bolt 10 and washer 12 prevents the anchoring system from loosening due to vibrations.

Tests were performed to compare the self-righting abilities of a sign post holding 18 inch×36 inch sign panels and configured with and without a rebound mechanism.

Test 1: Post and Sign without Rebound Mechanism

In a first sample, two 18 inch by 36 inch sign panels, having weights set forth below in Table 1, were fabricated and mounted so that the bottom of the panel(s) was above a post bending location. In a second sample, a single sign panel was secured to a post.

The sign panel(s) were secured to a DuraPost® delineator post (three (3) inches in diameter) using 10-24×⅝ inch screws fastened to a metal strip positioned on the interior of the post. The double panels were further bolted together at the top above the post. A base was configured from a RubberTough® portable rectangular mat fitted with a bracket made from a DuraPost® soil anchor. The post was mounted in the RubberTough® portable rectangular base. The panels were bent approx 90° by hand, then released. The single panel post rebounded, albeit slowly, when tested two times. However, on the third try it failed to return to vertical. The same method was performed on the double panel post and it failed to rebound on the first try.

TABLE 1

Item Weights:

| Description | Weight (lbs) |
|---|---|
| 8" × 24" panel only | 1.1 |
| 8" × 24" single panel assembly | 3.4 |
| 8" × 24" double panel assembly | 4.7 |

Test 2: Post and Sign with Rebound Mechanism

A second test was run to evaluate the capabilities of a return mechanism. The test conditions are set forth in Table 2.

TABLE 2

Test Conditions:

| Test Parameter | Value | |
|---|---|---|
| Test Temperature | Oct. 13, 2005 | Start 88° F.<br>End: 88° F. |
| | Oct. 14, 2005 | Start 75° F.<br>End: 76° F. |
| | Weather Cond: Dry & Sunny | |
| Impacting Vehicle | 1997 Mercury Cougar<br>1990 Ford Festiva | |
| Vehicle Speeds | 20 mph 20 Impacts<br>25 mph 10 Impacts | |
| Impact Type | 10 Bumper Impacts, one direction<br>25 Wheel Over Impacts, one direction | |
| Impact Angles | 0° | |

The test included bumper impacts at 20 mph, 20 mph wheel-overs and 25 mph wheel overs.

Test Article Configuration and Assembly:

TABLE 3

Test Article Description:

| Specimen | Description |
|---|---|
| 1, 2 | SHL36SMR -- OX 3 × 36 DuraPost with single STPG5WHA18 18" × 36" Panel.<br>Panel mounted to post using P/N 2517104-0000 signpost mounting strip system.<br>Post mounted in prototype quick-release base bolted to the asphalt. |
| 3 | SHL36SMR -- OX 3 × 36 DuraPost with single STPG5WHA18 18" × 36" Panel.<br>Panel mounted to post using P/N 2517104-0000 signpost mounting strip system.<br>Post mounted in modified quick release portable rectangular rubber mat. |
| 4, 5 | SHL36SMR -- OX 3 × 36 DuraPost with two STPG5WHA18 18" × 36" Panels.<br>Panels mounted to post using P/N 2517104-0000 signpost mounting strip system.<br>Post mounted in prototype quick-release base bolted to the asphalt. |
| 6 | SHL36SMR -- OX 3 × 36 DuraPost with two STPG5WHA18 18" × 36" Panels.<br>Panels mounted to post using P/N 2517104-0000 signpost mounting strip system.<br>Post mounted in modified quick release portable rectangular rubber mat. |

The sign panels were mounted to the post using modified P/N 2517104-0000 panel mounting strips disposed inside the post tube. Sheet metal screws were used to hold the panels to the mounting strip and post. This mounting system was selected not for its robustness, but rather because it allowed easy access to the inside of the DuraPost® tube for development of the rubber spring rebound mechanism. The post was secured using a quick-release mounting socket connecting the post to a RubberTough® portable rectangular rubber mat.

A Neoprene rubber spring tube was secured to a bottom steel support with a chain running through the length of the spring tube. The steel support was configured with a plate and a stem. The stem has a hole in it through which a horizontal post pin secures the post to the base. The steel support acts as a spring mounting plate as well as a strengthener for the base area. In this way, the spring tube is clamped between the steel support washer an upper washer by way of the chain. The chain assembly, which holds the rubber spring tube to the support plate, was fabricated by welding screws to each end of the chain. To assemble the unit, one end of the chain is screwed into the support plate, then the Neoprene tube is slid over the chain and then a washer and nut are installed and tightened to the end of the screw attached to the upper end of the chain. The upper screw was double-nutted to lock the assembly together.

Two different size Neoprene tubes were used; McMaster-Carr P/N 8637K22 1½ inch O.D.×⅞ inch I.D.×12 inch L Neoprene spring rubber tubing for the single panel post and McMaster-Carr P/N 8637K25 1⅞ inch O.D.×½ inch I.D.×12 inch L Neoprene spring rubber tubing for the double panel post. The 8637K25 tube I.D. was bored out by about 1/16 inches to allow the #2 chain to fit through the middle thereof.

To complete the post assembly, the full spring assembly is dropped into the bottom of the post (with the panel(s) removed) and a ¼ inch-20 bolt is threaded into the bottom of the support plate stem. The hole in the stem was lined up with the pin holes in the post. The socket mount plate was then installed on the post and the ¼ inch bolt was tightened to snug the support plate to the bottom of the post. A 3/16 inch×3 inch bolt was inserted through the assembly (socket plate, post and support plate stem), and secured with a nut to hold the whole assembly together. The ¼ inch bolt was then removed from the bottom of the support plate stem. The panels are then installed to complete the post.

Test Results: The Neoprene rubber spring rebounding mechanisms held up extremely well and showed no signs of fatigue or wear. Post 5 began to lean around impact 15. By the 17th impact, the post was leaning approximately 45°. The leaning was observed, however, to be caused by the bolt used to hold the post to the socket being bent. Other failures occurred between the sign panel and post interface, which did not have an effect on the rebound capability of the mechanism. In particular, the rubber spring rebound mechanism brought the post upright even with two large sign panels mounted on it.

The test data for the impacts is reported at Table 4:

TABLE 4

| DuraPost With Vertical Panels | | | | | | | |
|---|---|---|---|---|---|---|---|
| Vehicle Speed | Impact | 1 Single Panel | 2 Single Panel | 3 Single Panel | 4 Double Panels | 5 Double Panels | 6 Double Panels |
| 20 mph Bumper Impacts (Hits 1-10) | 1 | | | One screw out | One screw out | | |
| | 2 | | | | | | Mat fell over and dragged by vehicle |
| 10/14 | 5 | Steel strip broke Center screw out | | | Screw loosened | Screw out | |
| | 6 | | | | Screw out | | |
| | 10 | | | | Back panel slide down | | |
| 20 mph Wheel-Overs (Hits 11-20) | 12 | | | | Front panel off | | |
| | 15 | Bottom screw loose | | | | 25° lean | |
| | 16 | | | | | Bottom screw out | |
| | 17 | | | | | 45° lean | |
| | 20 | | | | | Top screw ripped out of post. Front panel hanging | |
| 25 mph Wheel-Overs (Hits 21-35) | 21 | Bottom screw out | | | | | |
| | 23 | Panel off | | | | | |
| | 24 | | Front panel off | | | | |

When comparing the data from the two tests, it is evident that the inner spring member provided significant improvement in the ability of a post configured with sign panels to return to an upright condition after being impacted by a vehicle. Indeed, without the inner tube, the post configured with two sign panels was incapable of returning to an upright condition after only one bending.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A self-righting post assembly comprising:

a hinge tube having an interior cavity comprising an interior periphery;

an elastomeric inner member separate from said hinge tube and disposed in said interior cavity of said hinge tube;

an extension post separate from said hinge tube and separate from said elastomeric inner member, said extension post coupled to said hinge tube, wherein said extension post is disposed over and around said hinge tube and further comprising a fastener connecting said extension post and said hinge tube, wherein said extension post extends upwardly above an upper end of said hinge tube, and wherein said hinge tube is more flexible than said extension post; and a base, wherein said hinge tube is secured to said base with a vertically oriented fastener and a washer engaged by said vertically oriented fastener, wherein said washer has an outer periphery substantially mating with said interior periphery.

2. The self-righting post assembly of claim 1 wherein said hinge tube comprises an elastomeric material.

3. The self-righting post assembly of claim 1 wherein said interior cavity has a cylindrical shape defined by an inner diameter of said elastomeric hinge tube, said elastomeric inner member has an outer cylindrical shape defined by an outer diameter of said inner member.

4. The self-righting post assembly of claim 3 wherein said outer diameter of said inner member is less than said inner diameter of said hinge tube.

5. The self-righting post assembly of claim 1 wherein said fastener is disposed above a top of said inner member.

6. The self-righting post assembly of claim 5 wherein said sign panel is separate from said extension post and is attached thereto with a fastening device, wherein said extension post has a first width, and wherein said sign panel has a second width greater than said first width, wherein said sign panel extends laterally outwardly from said extension post.

7. The self-righting post assembly of claim 1 further comprising a sign panel secured to an upper end of said extension post.

8. The self-righting post assembly of claim 1 wherein said hinge tube further comprises an interior shoulder, wherein said washer is supported by said interior shoulder.

9. The self-righting post assembly of claim 1 wherein said inner member is more flexible than said extension post.

10. The self-righting post assembly of claim 1 wherein said extension post is disposed over said hinge tube such that a relative amount of overlap between said extension post and said hinge tube is 4-11% of the overall length of said extension post.

11. A self-righting post assembly comprising:

a hinge tube having an interior cavity comprising an interior shoulder;

an elastomeric inner member separate from said hinge tube and disposed in said interior cavity of said hinge tube;

a base adapted to be secured to a mounting surface;

a threaded fastener threadably connecting said hinge tube to said base, wherein said threaded fastener has a vertical orientation; and a washer engaged by said threaded fastener, wherein said washer is supported by said interior shoulder and clamps said hinge tube between said washer and said base.

12. The self-righting post assembly of claim 11 further comprising an extension post disposed over said hinge tube and a sign panel secured to an upper end of said extension post.

13. The self-righting post assembly of claim 12 wherein said sign panel is separate from said extension post and attached thereto with a fastening device, wherein said extension post has a first width, and wherein said sign panel has a second width greater than said first width, wherein said sign panel extends laterally outwardly from said extension post.

14. The self-righting post assembly of claim 12 wherein said extension post is secured to said hinge tube with a mechanical fastener.

15. The self-righting post assembly of claim 14 wherein said mechanical fastener is disposed above a top of said inner member and said inner member is free of any connection to said extension post.

16. The self-righting post assembly of claim 12 wherein said extension post extends upwardly above an upper end of said hinge tube, and wherein said hinge tube is more flexible than said extension post.

17. The self-righting post assembly of claim 11 wherein said hinge tube comprises an elastomeric material.

18. A self-righting post assembly comprising:

a tube comprising a bottom end portion and having an interior cavity with an upper clamping surface formed on an interior periphery of said cavity and a lower clamping surface formed on said bottom end portion below said upper clamping surface;

a base comprising a socket receiving said bottom end portion such that said bottom end portion is non-pivotable relative to said base about a horizontal axis, wherein said base engages said lower clamping surface;

a clamping member engaging said upper clamping surface; and a vertically oriented fastener engaging and extending between said clamping member and said base, wherein said fastener applies a compressive force to said tube between said upper and lower clamping surfaces.

19. The self-righting post of claim 18 wherein said upper clamping surface comprises an interior circumferential shoulder formed on said interior periphery.

20. The self-righting post of claim 19 wherein said lower clamping surface comprises an exterior circumferential shoulder formed on an exterior periphery of said tube.

21. The self-righting post of claim 20 wherein said tube has a first diameter above said exterior circumferential shoulder, and a second diameter below said exterior circumferential shoulder, wherein said first diameter is greater than said second diameter.

22. The self-righting post of claim 18 wherein said fastener comprises a threaded fastener threadably engaging one of said base or a threaded securing member disposed above said clamping member.

23. The self-righting post of claim 18 wherein said tube comprises an elastomeric material, and further comprising an elastomeric inner member disposed in said tube free of any connection thereto, such that said inner member is freely moveable in said tube.

24. The self-righting post of claim 18 further comprising a post secured to said tube.

25. The self-righting post of claim 24 further comprising a sign panel secured to said post.

26. The self-righting post of claim 24 wherein said post is secured to said tube with at least one fastener at a location disposed above a top of said inner member.

27. The self-righting post of claim 18 wherein said tube has a first horizontal cross-sectional configuration at a first vertical location and a second horizontal cross-sectional configuration at a second vertical location, wherein said second horizontal cross-sectional configuration is different than said first horizontal cross-sectional configuration.

28. The self-righting post assembly of claim 27 wherein said tube comprises a plurality of ribs extending radially inwardly from said interior surface and defining in part said first cross-sectional configuration.

* * * * *